US010125581B2

(12) United States Patent
Nelson et al.

(10) Patent No.: US 10,125,581 B2
(45) Date of Patent: Nov. 13, 2018

(54) METHOD AND APPARATUS FOR BIT RUN AND RETRIEVED CASING HANGER LOCKING DEVICE

(71) Applicant: Dril-Quip, Inc., Houston, TX (US)

(72) Inventors: John E. Nelson, Houston, TX (US); Bruce J. Witwer, Cypress, TX (US)

(73) Assignee: Dril-Quip, Inc., Houston, TX (US)

( * ) Notice: Subject to any disclaimer, the term of this patent is extended or adjusted under 35 U.S.C. 154(b) by 331 days.

(21) Appl. No.: 14/973,128

(22) Filed: Dec. 17, 2015

(65) Prior Publication Data

US 2017/0175496 A1 Jun. 22, 2017

(51) Int. Cl.

| | |
|---|---|
| ***E21B 43/10*** | (2006.01) |
| ***E21B 33/14*** | (2006.01) |
| ***E21B 33/043*** | (2006.01) |
| ***E21B 33/04*** | (2006.01) |
| ***E21B 33/05*** | (2006.01) |
| ***F16L 55/00*** | (2006.01) |

(52) U.S. Cl.
CPC ..... *E21B 43/10* (2013.01)

(58) Field of Classification Search
None
See application file for complete search history.

(56) References Cited

U.S. PATENT DOCUMENTS

| | | | | |
|---|---|---|---|---|
| 4,836,288 | A * | 6/1989 | Wester | E21B 33/043 166/340 |
| 5,105,888 | A * | 4/1992 | Pollock | E21B 33/043 166/208 |
| 9,506,329 | B2 * | 11/2016 | Massey | E21B 43/10 |
| 9,689,229 | B2 * | 6/2017 | Hanson | E21B 33/0415 |

* cited by examiner

*Primary Examiner* — Matthew R Buck
*Assistant Examiner* — Douglas S Wood
(74) *Attorney, Agent, or Firm* — Baker Botts L.L.P.

(57) ABSTRACT

An apparatus and methods for installing and selectively retrieving a casing hanger locking device within a wellhead system during the bit run and retrieval operations are provided. An embodiment is an apparatus comprising: a bit sub comprising a tong neck, a cylindrical portion below the tong neck, and at least one stabilizing fin below the cylindrical section, wherein the at least one stabilizing fin comprises a keyway; a casing hanger locking device comprising an annular structure and an expandable ring disposed around an upper portion of the annular structure, the casing hanger locking device disposed around the bit sub; an actuation sleeve that engages with the casing hanger locking device; and a selective retrieval collar comprising a segmented retrieval ring, wherein the selective retrieval collar is attached to the bit sub, the actuation sleeve, and the casing hanger locking device.

18 Claims, 8 Drawing Sheets

METHOD AND APPARATUS FOR BIT RUN AND RETRIEVED CASING HANGER LOCKING DEVICE

BACKGROUND

The present disclosure provides an apparatus and methods for installing and selectively retrieving a casing hanger locking device within a wellhead system during the bit run and retrieval operations.

Natural resources such as oil or gas residing in a subterranean formation can be recovered by drilling a wellbore that penetrates the formation. The drilling operation involves the use of a drill bit at the end of a drill string to cut through the ground and drill the wellbore. A drilling fluid may be circulated downwardly through the drill string and then upwardly through the wellbore to the surface. The drilling fluid may be used to, among other things, cool the drill bit, lubricate the rotating drill string to prevent it from sticking to the walls of the wellbore, and remove drill cuttings from the wellbore.

During the drilling operations, the wellbore passes through subterranean formations with a variety of geological characteristics. Many of these subterranean formations contain fluids, including water and hydrocarbons, known as formation fluids. The formation fluids often exist at high temperatures and pressures. In certain circumstances, the high temperatures and pressures in the subterranean formation lead to upward loads and/or forces that require the pressures of the formation fluids to be controlled.

In ideal circumstances, the pressures of the formation fluids may be controlled by balancing the pressure of the formation fluid with the hydrostatic pressure of a drilling fluid. The weight of the drilling fluid, which can be adjusted by adding weighting agents, is usually sufficient to control the subterranean pressure and prevent the upward loads.

The subterranean pressures can change, however, and sometimes these changes can be sudden and unpredictable. For example, if the drill bit penetrates a formation with a higher pressure, the hydrostatic pressure of the drilling fluid may not be sufficient to balance this increased pressure of the formation fluid. In certain instances, this can lead to a blowout. Blowouts lead to loss of pressure control and possible heat transfer of (uncontrolled) fluid. These aspects in turn lead to increased annulus pressure, thermal growth which leads to mechanical loads, and direct mechanical loads.

Steps must be taken to control the upward loads from the formation fluids in the subterranean formation and the wellbore during the drilling operation. If these steps are not taken, the upward load can unseat the casing hanger used in the wellbore. This may result in the possible failure of the casing hanger annulus seal, which can lead to further loss of pressure control. Unseating the casing hanger can also create mechanical interference with separate pressure control or containment devices. The failure to control the upward loads in the wellbore can lead to loss of operator control in the drilling operations, damage to the drilling equipment, and even injury to the personnel on site.

Mechanical locking devices are used to control the upward loads and prevent the upward travel of the casing hanger in a blowout condition or similar condition. The locking devices are typically installed at the top of the casing hanger at the wellhead. The locking devices are designed to resist upward loads so that the casing hanger does not travel upward through the wellbore even if the subterranean pressure spikes. Thus, even when subterranean fluids flow upward, the casing hanger remains locked in place and does not interfere with the pressure control and containment devices.

Locking devices can be difficult and expensive to use, however. For example, subsequent casing runs cannot be made with the locking device installed in the wellhead because the locking device interfaces with many of the same components with which the next casing hanger would interface. As a result, the locking device must be removed from the wellbore each time casing is added. Conventional locking devices require a dedicated trip to run and retrieve, and three total trips are required to use a conventional locking device. The first trip is typically a measurement trip to verify the position of the most previously installed casing hanger. The second trip is typically the installation of the locking device. And the third trip is typically the retrieval of the locking device. These trips can be substantial, particularly in subsea drilling operations, where the wellhead may be located thousands of feet below the ocean surface. Each trip requires dedicated tooling to perform the intended task, and at current rig rates, these operations become very expensive.

SUMMARY

The present disclosure provides an apparatus and methods for installing and selectively retrieving a casing hanger locking device within a wellhead system during the bit run and retrieval operations.

An embodiment of the present disclosure is an apparatus comprising: a bit sub comprising a tong neck, a cylindrical portion below the tong neck, and at least one stabilizing fin below the cylindrical section, wherein the at least one stabilizing fin comprises a keyway; a casing hanger locking device comprising an annular structure and an expandable ring disposed around an upper portion of the annular structure, the casing hanger locking device disposed around the bit sub; an actuation sleeve that engages with the casing hanger locking device; and a selective retrieval collar comprising a segmented retrieval ring, wherein the selective retrieval collar is attached to the bit sub, the actuation sleeve, and the casing hanger locking device. Optionally, the selective retrieval collar is attached to the bit sub with a first plurality of sheer pins; the selective retrieval collar is attached to the casing hanger locking device with a second plurality of sheer pins; and the selective retrieval collar is attached to the actuation sleeve with the segmented retrieval ring. Optionally, the keyway comprises a tapered section. Optionally, the casing hanger locking device further comprises at least one key that interfaces with the at least one keyway. Optionally, the at least one stabilizing fin further comprises at least one groove. Optionally, the bit sub further comprises at least one load shoulder. Optionally, the segmented retrieval ring is configured to selectively engage the actuation sleeve by a special operational function.

Another embodiment of the present disclosure is an apparatus comprising: a bit sub comprising a tong neck, a cylindrical portion below the tong neck, and at least one stabilizing fin below the cylindrical section, wherein the at least one stabilizing fin comprises a keyway; a casing hanger locking device comprising an annular structure and an expandable ring disposed around an upper portion of the annular structure, the casing hanger locking device disposed around the bit sub; an actuation sleeve that engages with the casing hanger locking device; and a selective retrieval collar, wherein the selective retrieval collar is attached to both the bit sub and the casing hanger locking device. Optionally, the selective retrieval collar is attached to the bit sub with a first plurality of sheer pins; the selective retrieval collar is attached to the casing hanger locking device with a second plurality of sheer pins; and the selective retrieval collar is not attached to the actuation sleeve. Optionally, the keyway comprises a tapered section. Optionally, the casing hanger locking device further comprises at least one key that interfaces with the at least one keyway. Optionally, the at least one stabilizing fin further comprises at least one groove. Optionally, the bit sub further comprises at least one load shoulder.

Another embodiment of the present disclosure is a method comprising: lowering an apparatus into a wellbore using a drill string, wherein the apparatus comprises: a bit sub comprising a tong neck, a cylindrical portion below the tong neck, and at least one stabilizing fin below the cylindrical section, wherein the at least one stabilizing fin comprises a keyway, a casing hanger locking device comprising an annular structure and an expandable ring disposed around an upper portion of the annular structure, the casing hanger locking device disposed around the bit sub, an actuation sleeve that engages with the casing hanger locking device, and a selective retrieval collar, wherein the selective retrieval collar is attached to both the bit sub and the casing hanger locking device; setting the casing hanger locking device in place in the wellbore; detaching the bit sub from the selective retrieval collar and the casing hanger locking device; lowering the bit sub further into the wellbore using the drill string to facilitate further drilling operations; and removing the drill string and the bit sub from the wellbore, wherein the bit sub engages the selective retrieval collar and removes the selective retrieval collar from the wellbore. Optionally, the casing hanger locking device remains in the wellbore after the bit sub and the selective retrieval collar have been removed from the wellbore. Optionally, the selective retrieval collar comprises a segmented retrieval ring and wherein the selective retrieval collar is attached to the actuation sleeve. Optionally, the step of removing the drill string and the bit sub from the wellbore further comprises removing the casing hanger locking device from the wellbore. Optionally, the step of detaching the bit sub from the selective retrieval collar and the casing hanger locking device further comprises rotating the bit sub relative to the selective retrieval collar and the casing hanger locking device. Optionally, the at least one stabilizing fin further comprises at least one groove, and wherein the step of detaching the bit sub from the selective retrieval collar and the casing hanger locking device further comprises at least one lock segment from the at least one groove. Optionally, the bit sub further comprises at least one load shoulder, and wherein the step of removing the drill string and the bit sub from the wellbore further comprises contacting the selective retrieval collar with the at least one load shoulder.

The features and advantages of the present invention will be readily apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DESCRIPTION OF THE PREFERRED EMBODIMENTS

The present disclosure provides an apparatus and methods for installing and selectively retrieving a casing hanger locking device within a wellhead system during the bit run and retrieval operations. This can save effort, time, and expense over the prior art locking devices that require dedicated trips to remove them from the wellbore each time a new casing section is added.

In certain embodiments, the apparatus of the present disclosure is an assembly that comprises three major components. The first component is a Casing Hanger Locking Device. The Casing Hanger Locking Device is the component of the apparatus that serves as the locking device and can resist upward loads. The Casing Hanger Locking Device may comprise an actuation sleeve. The second component is a Bit Sub. The Bit Sub is attached directly to the drill string and connects the apparatus of the present disclosure to the drill string. The third component is a Selective Retrieval Collar. The Selective Retrieval Collar is attached to both of the other components and provides for the selective retrieval or installation of the Casing Hanger Locking Device.

Illustrative embodiments of the present disclosure are described in detail below. In the interest of clarity, not all features of an actual implementation are described in this specification. It will of course be appreciated that in the development of any such actual embodiments, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The details of various illustrative embodiments will now be described with reference to the figures.

Figure 1:
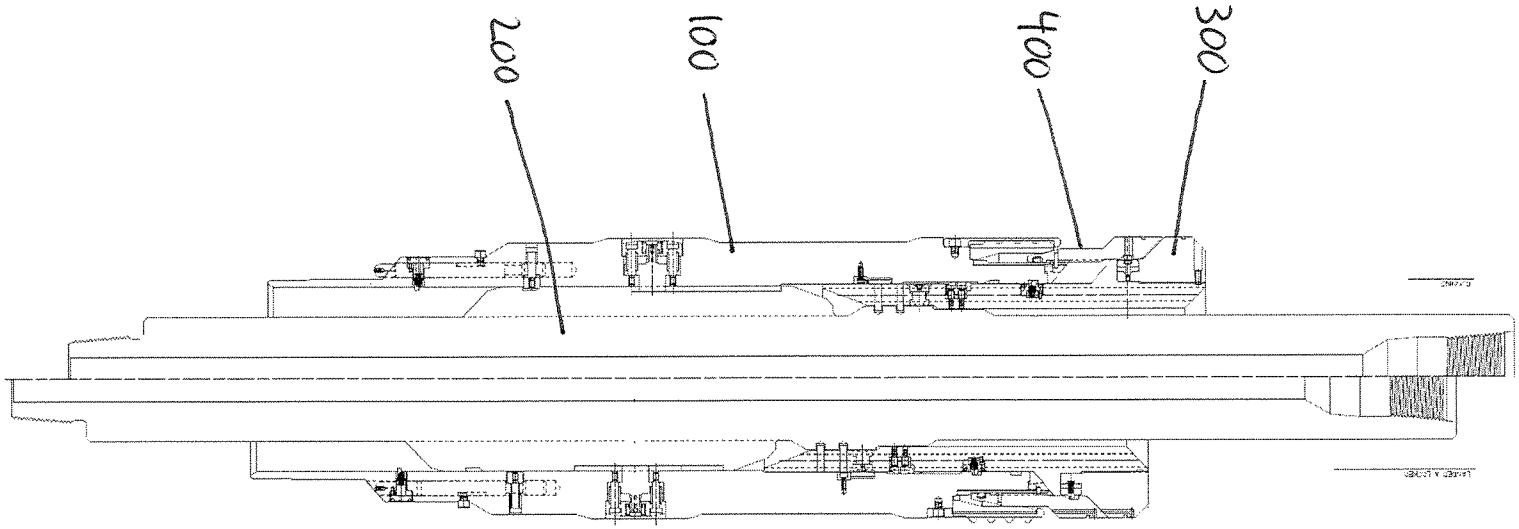
FIG. 1 illustrates an example of an assembled apparatus in accordance with an embodiment of the present disclosure.

FIG. 1 illustrates a cross-sectional view of an embodiment where the components of the apparatus are assembled. The Casing Hanger Locking Device 100 is provided and is generally in the shape of a tube or an annular ring. The Bit Sub 200 comprises the core of the assembly and is generally cylindrical in shape. The Casing Hanger Locking Device 100 fits around the Bit Sub 200 and is connected to the Bit Sub 200. The Selective Retrieval Collar 300 is generally in the shape of a tube or an annular ring. The Selective Retrieval Collar 300 fits between the Casing Hanger Locking Device 100 and the Bit Sub 200 and connects to both of these components. In certain embodiments, Selective Retrieval Collar 300 is at the top of the assembly. In other embodiments, however, Selective Retrieval Collar 300 may optionally be at the bottom of the assembly. The actuation sleeve 400 fits around the Selective Retrieval Collar 300 and engages with the Casing Hanger Locking Device 100.

In FIG. 1, the entire assembly is shown. The Casing Hanger Locking Device 100—which forms the exterior of the assembly—may be deployed adjacent to a wellhead (not shown). The Casing Hanger Locking Device 100 may be positioned above the casing hanger (not shown). The Casing Hanger Locking Device 100 functions as the locking device and can resist upward loads in the wellbore. In particular, the Casing Hanger Locking Device 100 resists casing hanger movement by transferring upward load from the casing hanger into load shoulders within the wellhead. In other words, when the Casing Hanger Locking Device 100 is installed, it may mechanically prevent upward movement by the casing hanger.

Figure 2A:
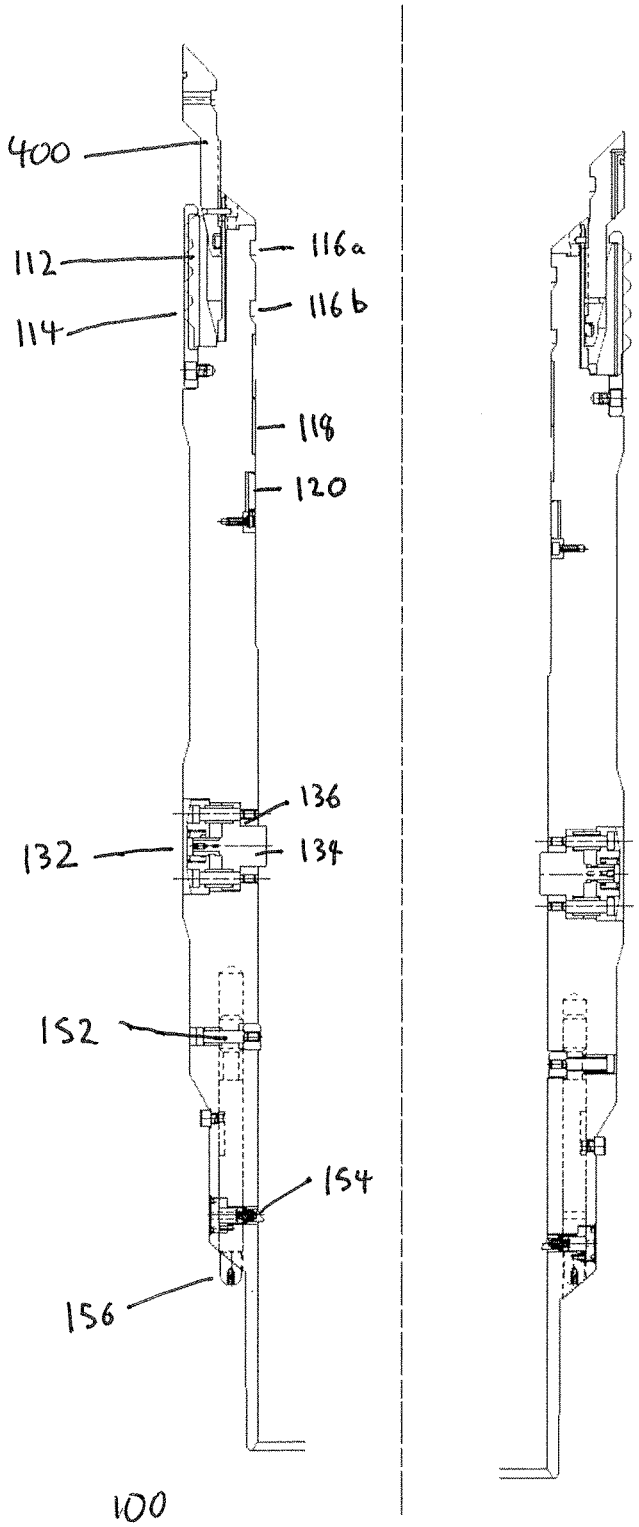
FIGS. 2*a*-2*c* illustrate an example of a casing hanger locking device in accordance with an embodiment of the present disclosure.
Figure 2B:
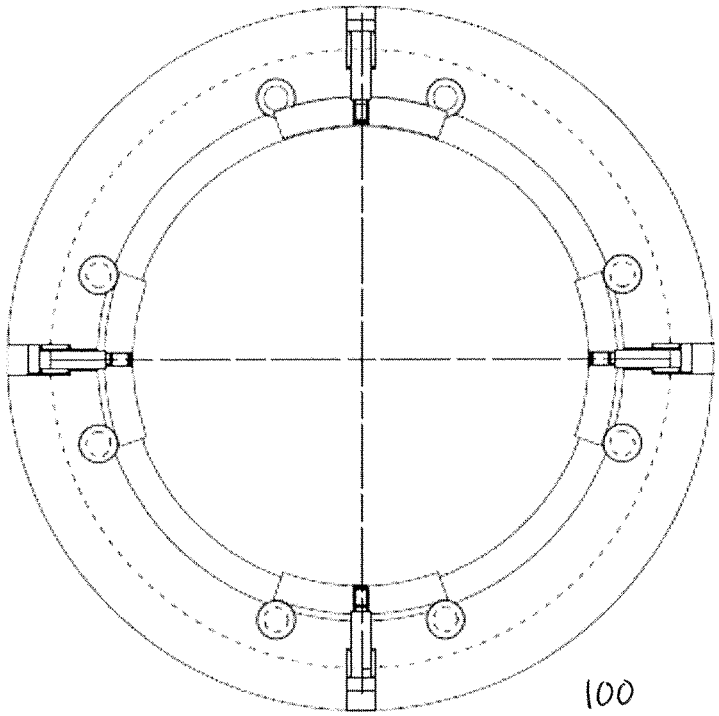
Figure 2C:
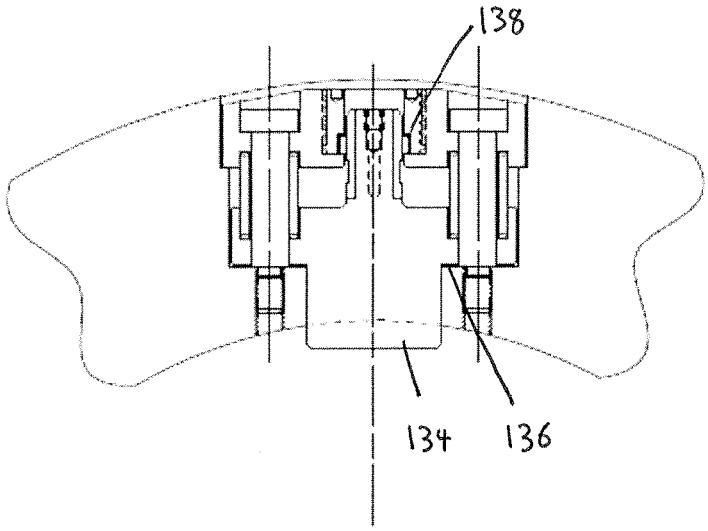

FIGS. 2*a*, 2*b* and 2*c* illustrate an embodiment of the Casing Hanger Locking Device 100 and the actuation sleeve 400. FIG. 2*a* illustrates a profile view of the Casing Hanger Locking Device 100 along its axis. FIG. 2*b* illustrates a cross-section of the Casing Hanger Locking Device 100 perpendicular to its axis. FIG. 2*c* illustrates a sectional view of an embodiment of a spring loaded square key 134 that will be described in more detail below. As shown in the exemplary embodiment of FIGS. 2*a*, 2*b* and 2*c*, the Casing Hanger Locking Device 100 may be an annular structure with an upper end, a mid-section, and a lower end. When it is installed, the Casing Hanger Locking Device 100 can be locked in place through the use of an expandable ring 112 located at its upper end. The Casing Hanger Locking Device 100 locks during a designed operation by way of load shoulders 114 on the expandable ring 112 that engage a designed profile within the wellhead.

As shown in FIG. 2*a*, the upper end of the Casing Hanger Locking Device 100 supports the expandable ring 112. The upper end also engages with the actuation sleeve 400. The left side of FIG. 2*a* shows the Casing Hanger Locking Device 100 in its running position. The right side of FIG. 2*a* shows the Casing Hanger Locking Device 100 in its locked and landed position. When the Casing Hanger Locking Device 100 is locked, the actuation sleeve 400 moves down and forces the expandable ring 112 in an outward axial direction. When the Casing Hanger Locking Device 100 is set in the wellhead (as discussed below), this permits the load shoulders 114 to engage the profile in the wellhead.

The interior surface of the upper end of the Casing Hanger Locking Device 100 may have an upper shear pin groove 116*a* and a lower sheer pin groove 116*b*. The upper shear pin groove 116*a* and a lower sheer pin groove 116*b* are configured to engage sheer pins connected to the Selective Retrieval Collar 300. The lower side of the upper shear pin groove 116*a* and a lower sheer pin groove 116*b* may be beveled to allow the Selective Retrieval Collar 300 to move in a downward direction relative to the Casing Hanger Locking Device 100 without breaking the sheer pins. The interior surface of the upper end of the Casing Hanger Locking Device 100 may also have a groove 118. Casing Hanger Locking Device 100 also includes a C-ring 120.

The mid-section of the Casing Hanger Locking Device 100 includes a plurality of keyway slots 132 that extend through the wall of the Casing Hanger Locking Device 100. The keys 134 in the keyway slots 132 have a stop shoulder 136 on them to prevent them from passing through the keyway slot 132. These keys 134 are spring loaded inward. In some embodiments, the keys 134 may be square. As described below in more detail, the keys 134 may be used to attach the Casing Hanger Locking Device 100 to the Bit Sub 200.

The lower end of the Casing Hanger Locking Device 100 is designed to rest on the casing hanger and extends into the bowl of the casing hanger (not shown in FIG. 2) to protect these surfaces. The interior surface of this lower end of the Casing Hanger Locking Device 100 has spring loaded lock segments 152 that engage the Bit Sub 200 when the assembly is in a running position. The Casing Hanger Locking Device 100 also includes sheer pins 154 and spherical nose pins 156. When the Casing Hanger Locking Device 100 is deployed into the well, the spherical nose pins 156 contact the casing hanger 600. This causes the sheer pins 154 to break and releases the lock segments 152.

As noted earlier, FIG. 2*b* illustrates a cross-section of the same embodiment of the Casing Hanger Locking Device 100 perpendicular to its axis. FIG. 2*c* illustrates a sectional view through the spring loaded key 134. This key 134 is shown extending into the bore of the Casing Hanger Locking Device 100. The c-ring 138 on the rod section of the key is shown expanded condition. The groove on the rod section will prevent the key from moving back to its current position once it is retracted.

Figure 3A:
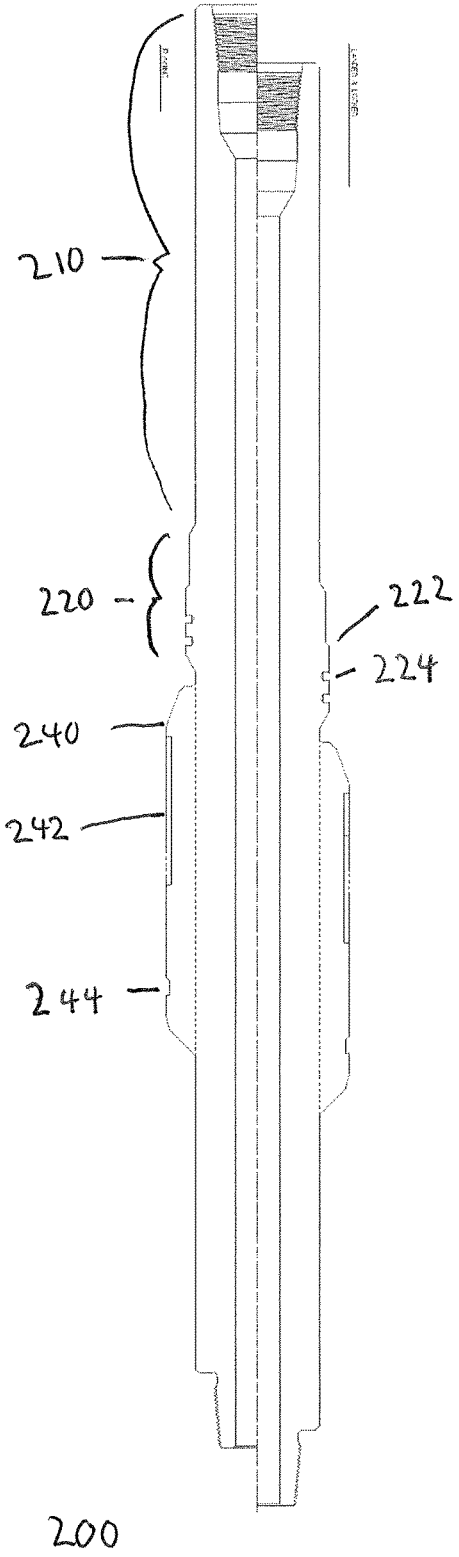
FIGS. 3*a*-3*b* illustrate an example of a bit sub in accordance with an embodiment of the present disclosure.
Figure 3B:
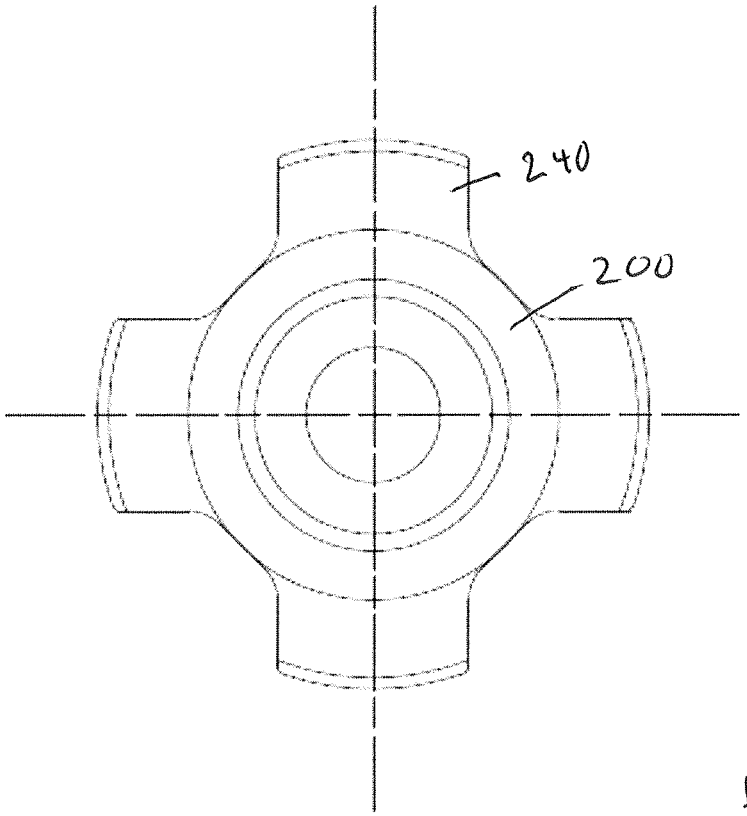

FIGS. 3*a* and 3*b* illustrate an embodiment of the Bit Sub 200. FIG. 3*a* illustrates a profile view of the Bit Sub 200 along its axis. FIG. 3*b* illustrates a cross-section of the Bit Sub 200 that is perpendicular to its axis. The Bit Sub 200 is similar to a standard stabilizer sub. The stabilizer sub acts as the running tool for the Casing Hanger Locking Device 100. The Bit Sub 200 typically connects to the drill string above the drill bit. It interfaces with the drill string on both ends, providing the necessary means to deliver, lock, verify, and retrieve the Casing Hanger Locking Device 100.

As shown in the exemplary embodiment of FIG. 3*a*, the Bit Sub 200 may comprise a tong neck 210 and cylindrical section 220 below the tong neck 210. The cylindrical section 220 may have a load shoulder 222 that is configured to engage with the Selective Retrieval Collar 300. The cylindrical section 220 also has drilled holes 224 that accept shear pins. The shear pins may be used to release the Bit Sub 200 after it lands in the wellhead. These shear pins connect the Bit Sub 200 to the Selective Retrieval Collar 300 during deployment and installation. They are sheared during operation to allow further deployment of the Bit Sub 200 downhole for continued drilling operations.

As further shown in FIG. 3*a*, the Bit Sub 200 also has load carrying taper in the stabilizing fins 240 (upper surface). These stabilizing fins 240 have a wide milled keyway 242 that extends vertically downward. This keyway 242 will interface with the square keys 134 in the Casing Hanger Locking Device 100. In some embodiments, the keyway 242 have a tapered section 243 on one face of the slot near the upper end of the keyway. In other embodiments, the keyway 242 may have the face in this area removed. This area of the keyway 242 is provided in order that the stabilizing fins 240 may escape the slot when the drill string is rotated. Below this keyway 242 is a machined groove 244 that extends across the stabilizing fin 240. This machined groove 244 will provide the load shoulders for the over-pull check that will ensure the Casing Hanger Locking Device 100 is locked into place.

FIG. 3*b* shows the cross section of Bit Sub 200 including the stabilizing fins 240. The keyway 242 can be seen in the profile of the stabilizing fin 240. The tapered section 243 is also visible.

Figure 4A:
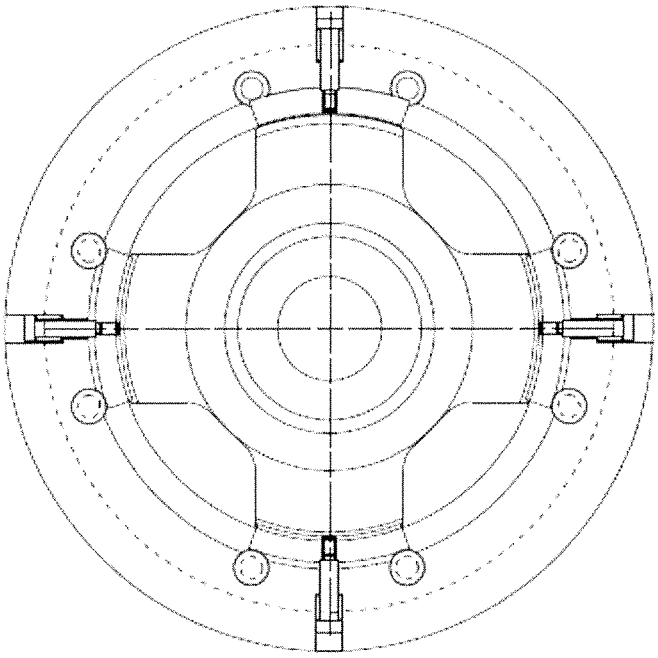
FIGS. 4*a*-4*b* illustrate how the casing hanger locking device may interface with the bit sub in accordance with an embodiment of the present disclosure.
Figure 4B:
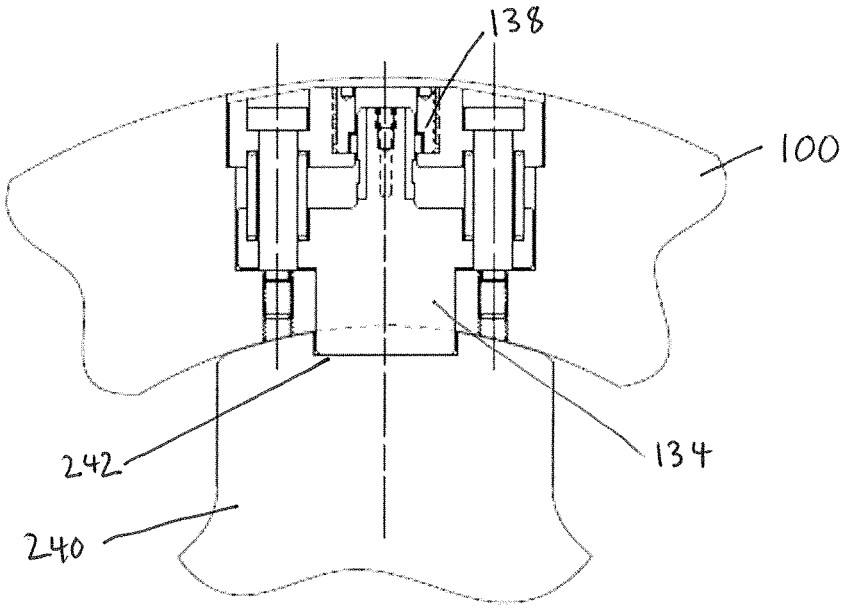

FIGS. 4*a* and 4*b* are cross-sectional views that are perpendicular to the axis of the assembly. FIGS. 4*a* and 4*b* demonstrate how the Casing Hanger Locking Device 100 may surround and interface with the Bit Sub 200 when the apparatus is assembled. In particular, the square keys 134 pass through the wall of the Casing Hanger Locking Device 100 through the keyway slots 132 (not labeled in FIG. 4). The square keys 134 fit in the keyway 242 of the stabilizing fins 240.

Figure 5A:
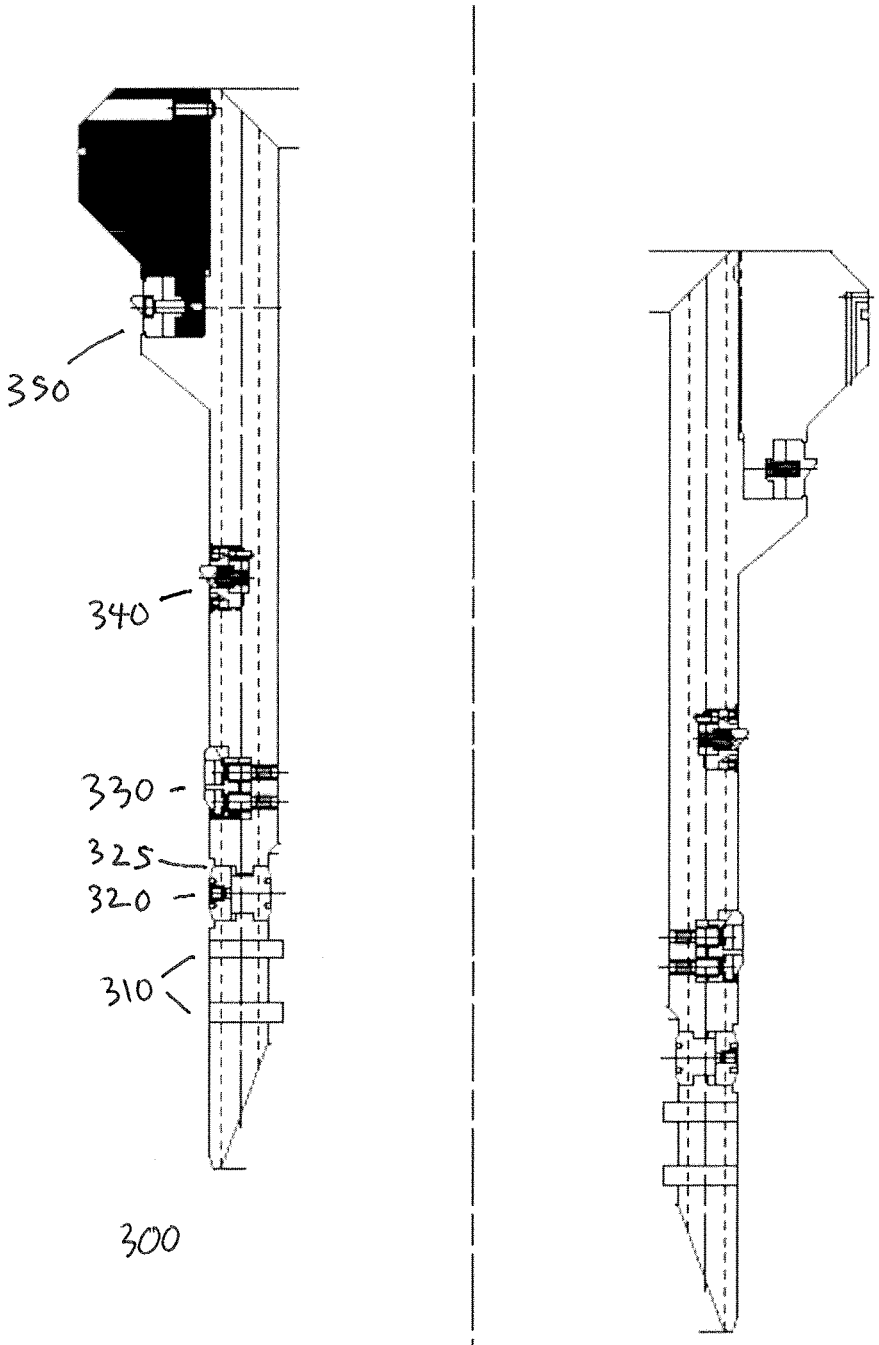
FIGS. 5*a*-5*b* illustrate an example of a selective retrieval collar in accordance with an embodiment of the present disclosure.
Figure 5B:
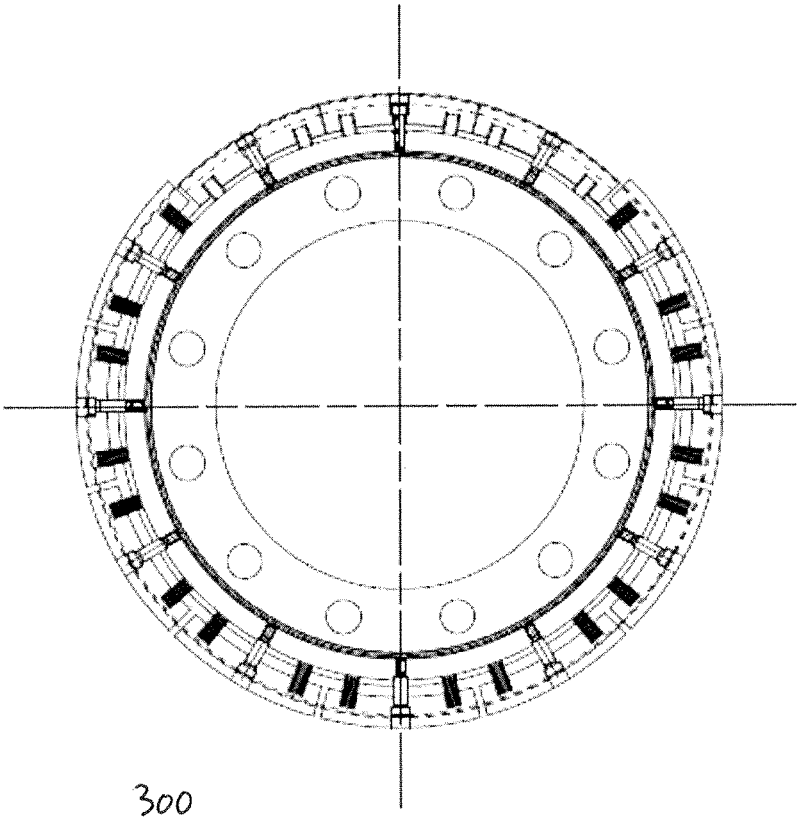

FIGS. 5*a* and 5*b* illustrate an embodiment of the Selective Retrieval Collar 300. FIG. 5*a* illustrates a profile view of the Selective Retrieval Collar 300 along its axis. FIG. 5*b* illustrates a cross-section of the Selective Retrieval Collar 300 that is perpendicular to its axis. The Selective Retrieval Collar 300 interfaces with both the Casing Hanger Locking Device 100 and the Bit Sub 200. This component also provides the functionality that allows the operator to predetermine if the Casing Hanger Locking Device 100 is to be retrieved on the same trip or left behind.

In the embodiment of FIG. 5*a*, the Selective Retrieval Collar 300 has holes 310 that accept shear pins, which attach it to the Bit Sub 200. These holes 310 align with the drilled holes 224 of the Bit Sub 200. The shear pins in holes 310 break during the initial locking operation, whereby weight is slacked off the crown block/derrick and transferred into the Casing Hanger Locking Device 100 through the Bit Sub 200. The Selective Retrieval Collar 300 includes a load transfer pin 320. The load transfer pin 320 maybe positioned in a groove 325. The Selective Retrieval Collar 300 also has a spring loaded key 330 that engages the groove 118 in the Casing Hanger Locking Device 100 to prevent rotation that might lead to wear and damage. The inside diameter of the Selective Retrieval Collar 300 has several flow-by holes that run the length of the part. The lower cylindrical face of the Selective Retrieval Collar 300 will act upon the adjacent upper faces of the stabilizing fins 240 of the Bit Sub 200. The Selective Retrieval Collar 300 also has a row of shear pin pockets 340 that interfaces with Casing Hanger Locking Device 100.

Depending on whether the operator wishes to retrieve the Casing Hanger Locking Device 100 (as discussed below), the Selective Retrieval Collar 300 may take the form of either of two configurations. In the first configuration, Selective Retrieval Collar 300 includes a high strength segmented retrieval ring 350. In the second configuration, the Selective Retrieval Collar 300 does not include the high strength segmented retrieval ring 350.

The present disclosure in some embodiments include methods for using the apparatus of the present disclosure to carry out a variety of drilling operations. During drilling operations, the apparatus of the present disclosure is connected to the drill string. In certain embodiments, the apparatus of the present disclosure may be connected to the drill string above the drill bit. For example, the Bit Sub 200 may be connected to the drill string via industry-standard API tool joints. A person of ordinary skill in the art, with the benefit of this disclosure, would understand how to connect the apparatus to the drill string for the desired operations.

In certain embodiments, the apparatus of the present disclosure may be introduced into the wellbore as part of the drill string. The entire apparatus, including the Casing Hanger Locking Device 100, the Bit Sub 200, and the Selective Retrieval Collar 300, may be lowered into the wellbore according to conventional methods. For example, the drill string may be run into the wellbore.

Placing the Casing Hanger Locking Device:

When the apparatus of the present disclosure reaches the level of the casing hanger, the Casing Hanger Locking Device 100 may be locked into place. In an embodiment, the assembly is lowered with the drill string into the wellbore. When the assembly reaches the casing hanger, the Casing Hanger Locking Device 100 is unable to move any further downhole. However, the spherical nose pins 156 contact the casing hanger. The spherical nose pins 156 are depressed which causes the sheer pins 154 to break and releases the lock segments 152. The lock segments 152 disengage from the machined grooves 244 in the Bit Sub 200 which allows the Bit Sub 200 to move downward relative to the Casing Hanger Locking Device 100.

To set the Casing Hanger Locking Device 100 in place, the Bit Sub 200, the Selective Retrieval Collar 300, and the actuation sleeve 400 continue to move downhole. Sheer pins attaching the actuation sleeve 400 to the Casing Hanger Locking Device 100 break, allowing the actuation sleeve 400 to move relative to the Casing Hanger Locking Device 100. The actuation sleeve 400 moves down and forces the expandable ring 112 in an outward axial direction. This permits the load shoulders 114 to engage the profile in the wellhead, setting the Casing Hanger Locking Device 100 in place.

The Selective Retrieval Collar 300 remains connected to the Casing Hanger Locking Device 100 and the Bit Sub 200 disengages from both components. In particular, the sheer pins (in holes 310 Selective Retrieval Collar 300 and the drilled holes 224 of the Bit Sub 200) break and allow the Bit Sub 200 to move downward relative to the Selective Retrieval Collar 300.

As the Bit Sub 200 moves downward, it releases the load transfer pins 320. The C-ring 120 that is biased inwardly moves into the groove 325 on the Selective Retrieval Collar 300. If the Selective Retrieval Collar 300 is loaded upwardly, this load goes into these interfaces rather than the spring loaded shear pins 340.

At this point, an over-pull may be performed to ensure that the Casing Hanger Locking Device 100 is properly set. The operator may continue to trip in until his weight indicator shows he has tagged the bit sub keyway 242 on the square keys 134 in the Casing Hanger Locking Device 100. At this point an over-pull may be performed to ensure that the Casing Hanger Locking Device 100 is properly set.

The operator may then perform a rotation to completely disengage the Bit Sub 200 from the Casing Hanger Locking Device 100. Rotating the Bit Sub 200 rotates the stabilizing fin 240 relative to the square keys 134. This rotation allows the square keys 134 to be removed from the keyway 242, for example, by passing over the tapered section 243. As the stabilizing fin 240 retracts the square key 134 from the keyway 242, a c-ring 138 snaps into a groove on the square key's rod section. This will not allow the key to re-enter the bore of the Casing Hanger Locking Device 100. This completes the placement of the Casing Hanger Locking Device 100.

Following the placement of the Casing Hanger Locking Device 100, the drill string, including the drill bit and the Bit Sub 200, are free to continue running down the wellbore. Therefore, drilling operations may continue after the Casing Hanger Locking Device 100 has been placed. When the Casing Hanger Locking Device 100 is locked into place, it is capable of resisting upward loads on the casing. This ensures that the well is kept under control if the drill bit penetrates a subterranean formation with increased temperature and pressure.

At some point, the operator may wish to remove the drill string from the wellbore. For example, the operator may need to change the drill bit or use a different tool. The drill string including the Bit Sub 200 may be removed from the wellbore according to conventional methods. According to embodiments of the present disclosure, the Casing Hanger Locking Device 100 may be selectively retrieved or left behind when the Bit Sub 200 reaches the level of the wellbore where it has been placed. In particular, and as discussed below, Bit Sub 200 will always retrieve Selective Retrieval Collar 300 but it will either retrieve or leave the Casing Hanger Locking Device 100 depending on how the Selective Retrieval Collar 300 is configured.

The Casing Hanger Locking Device 100 may be selectively retrieved from the wellbore or left behind depending on the goal of the operator. For example, the Casing Hanger Locking Device 100 may be retrieved from the well bore under normal operations or, for example, when an additional casing is installed in the well bore. For example, an operator may retrieve the Casing Hanger Locking Device 100 when drilling operations are believed to be short enough to remove the locking device in preparation for subsequent casing hanger installation. Alternatively, the Casing Hanger Locking Device 100 may be left in the wellbore when the well bore needs to be sealed for a period of time. An operator may leave the Casing Hanger Locking Device 100 when, for example, the drilling operations are believed to be long enough to necessitate a drill bit replacement, there is possible inclement weather during drilling operations that would require a disconnect from the wellhead, or there are other reasons requiring temporary abandonment between drilling and production operations.

Whether the Casing Hanger Locking Device 100 is retrieved on the same trip or left behind is determined by the configuration of Selective Retrieval Collar 300. As explained in more detail below, when retrieving the Casing Hanger Locking Device 100, the operator will select the configuration of Selective Retrieval Collar 300 that includes a segmented retrieval ring 350. The row of pockets 340 is loaded with spring loaded shear pins. This arrangement will allow the Casing Hanger Locking Device 100 to be carried to the surface. When leaving the Casing Hanger Locking Device 100, the operator will select the configuration of Selective Retrieval Collar 300 that does not include a segmented retrieval ring 350 and the row 340 is loaded with spring loaded sheer pins.

Retrieving the Casing Hanger Locking Device:

In one configuration, the apparatus of the present disclosure may be used to retrieve the Casing Hanger Locking Device 100. In this first configuration, the Selective Retrieval Collar 300 is connected to the actuation sleeve 400 through the segmented retrieval ring 350. This ensures that the Selective Retrieval Collar 300 remains connected to the actuation sleeve 400. The row 340 that connects the Selective Retrieval Collar 300 to the Casing Hanger Locking Device 100 is loaded with spring loaded sheer pins.

As the Bit Sub 200 is removed from the well bore and pulled through the assembly, it tags out on the Selective Retrieval Collar 300. In particular, the shoulder 222 engages the Selective Retrieval Collar 300. The Selective Retrieval Collar 300 is connected to the actuation sleeve 400 through the segmented retrieval ring 350, and as a result, this mechanical action pulls on the actuation sleeve 400, which pulls on the Casing Hanger Locking Device 100. The Selective Retrieval Collar 300 is connected to the Casing Hanger Locking Device 100 with spring loaded sheer pins. The spring loaded sheer pins break, which permits the actuation sleeve 400 to be lifted sufficiently high enough to disengage the expandable ring 112 and unlock the Casing Hanger Locking Device 100 from the mating wellhead profile. In certain embodiments, additional shear pins (not shown) may also be used. Continuing to lift pulls on the Bit Sub 200, which pulls on the Selective Retrieval Collar 300, which pulls on the actuation sleeve 400, and which engages the Casing Hanger Locking Device 100 via a shoulder and removes it from the wellhead.

In certain embodiments, the apparatus of the present disclosure may be configured to permit the operator to determine whether to retrieve the Casing Hanger Locking Device 100 on the fly. In these embodiments, the Selective Retrieval Collar 300 may be provided with a segmented retrieval ring 350 as discussed above. However, in these embodiments, segmented retrieval ring 350 may be made passive and triggered to engage the actuation sleeve 400 by a special operational function. If the operational function is performed after the apparatus is deployed, the segmented retrieval ring 350 may engage the actuation sleeve 400 (to retrieve the Casing Hanger Locking Device 100). On the other hand, if the operational function is not performed after the apparatus is deployed, the segmented retrieval ring 350 will not engage the actuation sleeve 400 (to leave the Casing Hanger Locking Device 100 behind).

Leaving the Casing Hanger Locking Device:

In another configuration, the apparatus may be used to retrieve only the Bit Sub 200 and Selective Retrieval Collar 300. In this second configuration, a Selective Retrieval Collar 300 without a segmented retrieval ring 350 is selected, such that the Selective Retrieval Collar 300 is not connected to the actuation sleeve 400. This allows the Selective Retrieval Collar 300 to separate from the actuation sleeve 400. The row 340 that connects the Selective Retrieval Collar 300 to the Casing Hanger Locking Device 100 is loaded with spring loaded sheer pins. Spring loaded sheer pins are used so that a positive indication is given when the Selective Retrieval Collar 300 disengages from the Casing Hanger Locking Device 100.

As the Bit Sub 200 is pulled through the assembly, it tags out on the Selective Retrieval Collar 300, which pulls on the actuation sleeve 400, which pulls on the Casing Hanger Locking Device 100. The Selective Retrieval Collar 300 is pulled with sufficiently high force to shear the pins which attached it to the Casing Hanger Locking Device 100. When the sheer pins break, neither the Bit Sub 200 nor the Selective Retrieval Collar 300 is connected, either directly or indirectly, to the Casing Hanger Locking Device 100. Continuing to lift removes only the Bit Sub 200 and the Selective Retrieval Collar 300 from the wellhead.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Moreover, the indefinite articles "a" or "an", as used in the claims, are defined herein to mean one or more than one of the element that it introduces. Also, the terms in the claims have their plain, ordinary meaning unless otherwise explicitly and clearly defined by the patentee.

What is claimed is:

1. An apparatus comprising:

a bit sub comprising a tong neck, a cylindrical portion below the tong neck, and at least one stabilizing fin below the cylindrical section, wherein the at least one stabilizing fin comprises a keyway;

a casing hanger locking device comprising an annular structure, at least one key that interfaces with the at least one keyway, and an expandable ring disposed around an upper portion of the annular structure, the casing hanger locking device disposed around the bit sub;

an actuation sleeve that engages with the casing hanger locking device; and a selective retrieval collar comprising a segmented retrieval ring, wherein the selective retrieval collar is attached to the bit sub, the actuation sleeve, and the casing hanger locking device.

2. The apparatus of claim 1 wherein:

the selective retrieval collar is attached to the bit sub with a first plurality of sheer pins;

the selective retrieval collar is attached to the casing hanger locking device with a second plurality of sheer pins; and the selective retrieval collar is attached to the actuation sleeve with the segmented retrieval ring.

3. The apparatus of claim 1 wherein the keyway comprises a tapered section.

4. The apparatus of claim 1 wherein the at least one stabilizing fin further comprises at least one groove.

5. The apparatus of claim 1 wherein the bit sub further comprises at least one load shoulder.

6. The apparatus of claim 1 wherein the segmented retrieval ring is configured to selectively engage the actuation sleeve by a special operational function.

7. An apparatus comprising:

a bit sub comprising a tong neck, a cylindrical portion below the tong neck, and at least one stabilizing fin below the cylindrical section, wherein the at least one stabilizing fin comprises a keyway;

a casing hanger locking device comprising an annular structure, at least one key that interfaces with the at least one keyway, and an expandable ring disposed around an upper portion of the annular structure, the casing hanger locking device disposed around the bit sub;

an actuation sleeve that engages with the casing hanger locking device; and a selective retrieval collar, wherein the selective retrieval collar is attached to both the bit sub and the casing hanger locking device.

8. The apparatus of claim 7 wherein:

the selective retrieval collar is attached to the bit sub with a first plurality of sheer pins;

the selective retrieval collar is attached to the casing hanger locking device with a second plurality of sheer pins; and the selective retrieval collar is not attached to the actuation sleeve.

9. The apparatus of claim 7 wherein the keyway comprises a tapered section.

10. The apparatus of claim 7 wherein the at least one stabilizing fin further comprises at least one groove.

11. The apparatus of claim 7 wherein the bit sub further comprises at least one load shoulder.

12. A method comprising:

lowering an apparatus into a wellbore using a drill string, wherein the apparatus comprises:

a bit sub comprising a tong neck, a cylindrical portion below the tong neck, and at least one stabilizing fin below the cylindrical section, wherein the at least one stabilizing fin comprises a keyway, a casing hanger locking device comprising an annular structure and an expandable ring disposed around an upper portion of the annular structure, the casing hanger locking device disposed around the bit sub, an actuation sleeve that engages with the casing hanger locking device, and a selective retrieval collar, wherein the selective retrieval collar is attached to both the bit sub and the casing hanger locking device;

setting the casing hanger locking device in place in the wellbore;

detaching the bit sub from the selective retrieval collar and the casing hanger locking device;

lowering the bit sub further into the wellbore using the drill string to facilitate further drilling operations; and removing the drill string and the bit sub from the wellbore, wherein the bit sub engages the selective retrieval collar and removes the selective retrieval collar from the wellbore.

13. The method of claim 12 wherein the casing hanger locking device remains in the wellbore after the bit sub and the selective retrieval collar have been removed from the wellbore.

14. The method of claim 12 wherein the selective retrieval collar comprises a segmented retrieval ring and wherein the selective retrieval collar is attached to the actuation sleeve.

15. The method of claim 14 wherein the step of removing the drill string and the bit sub from the wellbore further comprises removing the casing hanger locking device from the wellbore.

16. The method of claim 12 wherein the step of detaching the bit sub from the selective retrieval collar and the casing hanger locking device further comprises rotating the bit sub relative to the selective retrieval collar and the casing hanger locking device.

17. The method of claim 12 wherein the at least one stabilizing fin further comprises at least one groove, and wherein the step of detaching the bit sub from the selective retrieval collar and the casing hanger locking device further comprises at least one lock segment from the at least one groove.

18. The method of claim 12 wherein the bit sub further comprises at least one load shoulder, and wherein the step of removing the drill string and the bit sub from the wellbore further comprises contacting the selective retrieval collar with the at least one load shoulder.

* * * * *